US007400739B2

(12) United States Patent
Akino

(10) Patent No.: US 7,400,739 B2
(45) Date of Patent: Jul. 15, 2008

(54) MICROPHONE DEVICE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 477 days.

(21) Appl. No.: 11/071,186

(22) Filed: Mar. 4, 2005

(65) Prior Publication Data

US 2005/0207604 A1 Sep. 22, 2005

(30) Foreign Application Priority Data

Mar. 17, 2004 (JP) ..... 2004-075589

(51) Int. Cl.
*H04R 25/00* (2006.01)

(52) U.S. Cl. ..... 381/361; 381/363; 381/368

(58) Field of Classification Search ..... 381/353, 381/354, 361, 362, 363, 366, 368; 248/638, 248/121, 559, 560
See application file for complete search history.

(56) References Cited

U.S. PATENT DOCUMENTS 3,947,646 A * 3/1976 Saito ..... 381/368
6,590,989 B2 * 7/2003 Chen ..... 381/363
6,922,475 B2 * 7/2005 Hsieh ..... 381/368

* cited by examiner

*Primary Examiner*—Huyen D Le
(74) *Attorney, Agent, or Firm*—Manabu Kanesaka

(57) ABSTRACT

A microphone device includes a support bracket, a microphone unit, and a unit mounter supported on the support bracket and holding the microphone unit thereon. The unit mounter includes a base, a connecting portion connected to the support bracket, and a thin portion situated between the base and the connecting portion and having an annular shape to operate as a vibration absorbing device. The base, connecting portion and thin portion are integrally formed together by one material such that the thin portion exhibits rubber elasticity to absorb vibration, and the base and the connecting portion are made thick to provide predetermined hardness required as a difficult-to-deform property.

5 Claims, 2 Drawing Sheets

MICROPHONE DEVICE

RELATED APPLICATIONS

The present application is based on, and claims priority from, Japanese Application Number 2004-075589, filed Mar. 17, 2004, the disclosure of which is hereby incorporated by reference herein in its entirety.

TECHNICAL FIELD

The present invention relates to a microphone device having a microphone unit which is supported in a microphone case via shock absorbing means (shock mount). More particularly, the present invention relates to a technique for improving support reliability and assembling workability of the microphone unit.

BACKGROUND ART

Both a condenser microphone and a dynamic microphone are provided with a diaphragm vibrated by acoustic waves. The diaphragm is vibrated not only by acoustic waves but also by vibrations applied, for example, through a microphone case, and thereby generates noise. Most of the noise is handling noise caused by rubbing the microphone case by hand.

To prevent such noise, when a microphone unit is housed in the microphone case, a shock mount having vibration absorbing power is provided between the microphone unit and the microphone case. As one example, Patent Document 1 (Japanese Patent Application Publication No. 2003-92792) has disclosed a microphone device having a shock mount applied to a stand microphone. An example of the construction thereof is shown in FIG. 3. FIG. 3A is a side sectional view, and FIG. 3B is a front sectional view.

This microphone device 1 includes a support bracket 2 and a unit mounter 3. The support bracket 2 is formed of a metal or a hard synthetic resin material, and is mounted on the not illustrated microphone case side.

The unit mounter 3 is mounted with a microphone unit M, and is provided with a shock mount 4 formed of a rubber elastic material, which serves as vibration absorbing means. The microphone unit M is supported on the support bracket 2 via the unit mounter 3. In this example, the microphone M is a unidirectional condenser microphone unit.

The unit mounter 3 is made up of three components; a unit case 3*a* for the microphone unit M, a support ring 3*b* for supporting the unit case 3*a*, and a base 3*c*. The unit case 3*a* is formed by a cylindrical body having many sound diffraction holes at the periphery, and incorporates a diaphragm and a backplate, which are principal components of the microphone unit M.

The support ring 3*b* is arranged around the unit case 3*a*, and is attached to the base 3*c* in a state of being tightened by a screw to prevent the unit case 3*a* from dropping. The unit mounter 3 is assembled in this manner, and then the unit mounter 3 is attached to the support bracket 2 via the shock mount 4 mounted on the base 3*c*.

According to the above-described microphone device 1, vibrations transmitted through the microphone case are absorbed or damped by the shock mount 4, so that vibration noise generated from the microphone unit M is reduced.

However, in the above-described microphone device 1, the unit mounter 3 is made up of three components of the unit case 3*a*, the support ring 3*b*, and the base 3*c*, and also the shock mount 4 is formed as a separate member, which increases the number of components.

Therefore, much manpower is required for assembly, and also the purchase cost of components is high. Also, the shock mount 4 is fittingly connected to the base 3*c* and an adhesive is also used as necessary. However, if a strong shock such as a drop shock is applied to the microphone device 1, the shock mount 4 may come off. Also, if the support ring 3*b* is tightened loose, the microphone unit M may be dropped together with the unit case 3*a* by a drop shock etc.

SUMMARY OF THE INVENTION

Accordingly, an object of the present invention is to provide a microphone device having a microphone unit which is supported in a microphone case via a shock mount, wherein support reliability and assembling workability of the microphone unit are improved.

To achieve the above object, the present invention provides a microphone device including a unit mounter mounted with a microphone unit and a support bracket provided on the microphone case side, in which the unit mounter is supported on the support bracket via vibration absorbing means, characterized in that the unit mounter has a base having a connecting portion for connecting the unit mounter to the support bracket; the base and the connecting portion are integrally formed by an elastic material exhibiting rubber elasticity; the base is formed by a thick body of the elastic material, which achieves predetermined hardness required as a base as a difficult-to-deform property; and the connecting portion includes a thin portion of the elastic material, which functions as the vibration absorbing means.

According to this configuration, since the shock mount is formed integrally with the base of the unit mounter, the number of components and the assembling manpower can be reduced accordingly, and the microphone device can be produced at a low cost without impairing the vibration isolating performance. Also, even if the microphone device is subjected to a strong shock such as a drop shock, the shock mount does not come off.

As a preferable mode, the present invention is characterized in that the base is formed integrally with a unit support portion for supporting the microphone unit as a thick body achieving predetermined hardness by means of the elastic material. According to this configuration, most of the components included in the unit mounter are formed integrally, so that the assembling manpower can be reduced significantly.

Also, the present invention is characterized in that the microphone unit is of a condenser type, and the unit support portion integrally includes a unit case for the microphone unit. According to this configuration, most of the components included in the unit mounter are formed integrally, so that the microphone unit can surely be prevented from dropping.

DETAILED DESCRIPTION

Figure 1A:
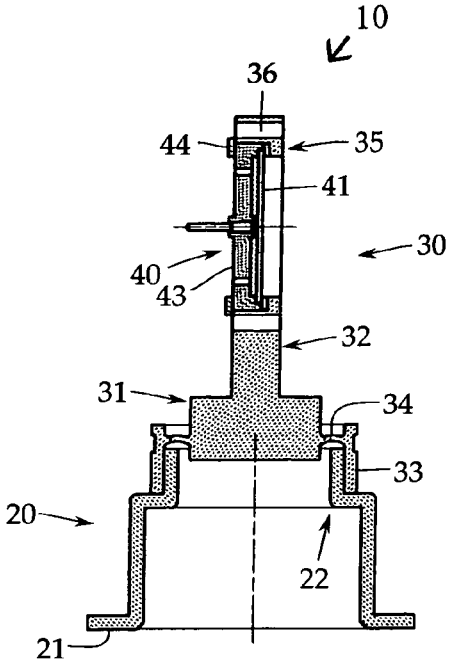
FIG. 1A is a side sectional view showing one example of a microphone device in accordance with the present invention.
Figure 1B:
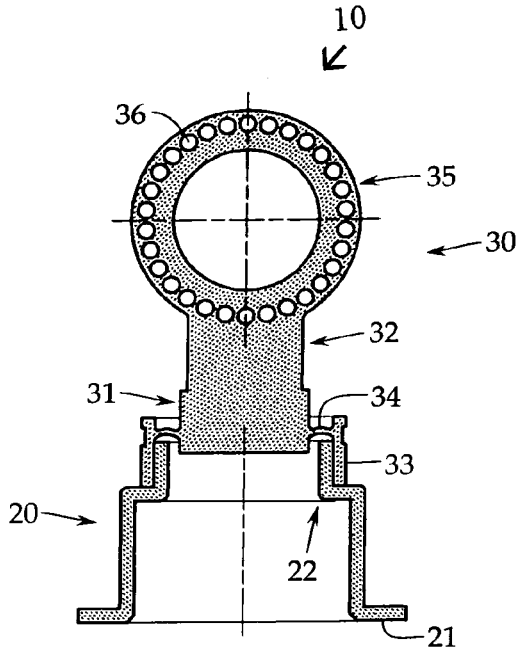
FIG. 1B is a front sectional view of FIG. 1A.
Figure 2:
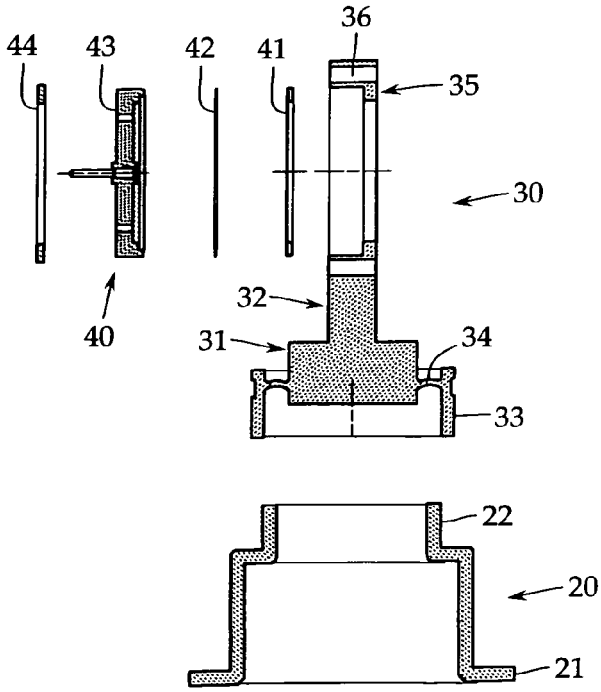
FIG. 2 is an exploded sectional view of the microphone device shown in FIG. 1.
Figure 3A:
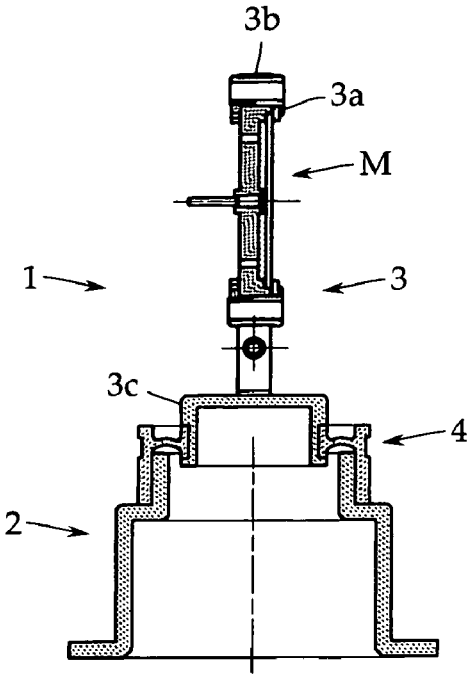
PRIOR ART FIG. 3A
FIG. 3A is a side sectional view of a conventional microphone device.

An embodiment of the present invention will now be described with reference to FIGS. 1 and 2. FIG. 1A is a side sectional view of a microphone device in accordance with the present invention, and FIG. 1B is a front sectional view of FIG. 1A, these figures corresponding to FIGS. 3A and 3B explained before, respectively. Also, FIG. 2 is an exploded sectional view of the microphone device in accordance with the present invention.

This microphone device 10 includes a support bracket 20 and a unit mounter 30. The support bracket 20 may be formed of a metal or a hard synthetic resin material. In this example, the support bracket 20 is formed as a cylindrical body having a fixing flange 21 for attaching the support bracket 20 to a microphone case, not shown, at the lower end thereof and a sleeve 22 for mounting the unit mounter 30 to the support bracket 20 at the upper end thereof.

In the before-mentioned stand microphone case described in Patent Document 1, the interior thereof is partitioned into a microphone unit storage portion surrounded, for example, by punching metal at the upper part and a circuit component storage portion at the lower part by a partitioning plate (not shown). The support bracket 20 is fixed on the partitioning plate.

The unit mounter 30 includes a base 31 having a connecting portion 33 for connecting the unit mounter 30 to the support bracket 20 and a unit support portion 32. The whole of the unit mounter 30 including the connecting portion 33 is integrally formed by an elastic body exhibiting rubber elasticity.

The base 31 of the unit mounter 30 is formed in a thick disc shape so as to achieve predetermined hardness (rigidity) required as a base. The connecting portion 33 is formed as a cylindrical body with a size larger than the base 31, and is fitted along the outer peripheral surface of the sleeve 22. As shown in FIG. 2, a shock mount (vibration absorbing means) 34 is integrally provided between the connecting portion 33 and the base 31. The shock mount 34 is an elastic body having vibration absorbing power, which is formed in a thin washer shape.

Also, the unit support portion 32 is formed in a thick column shape so as to achieve predetermined hardness enough to support a microphone unit 40. In this example as well, the microphone unit 40 is a unidirectional condenser microphone unit. The unit support portion 32 is formed integrally with a unit case 35 for the microphone unit 40, which has the same thickness as that of the unit support portion 32.

Figure 3B:
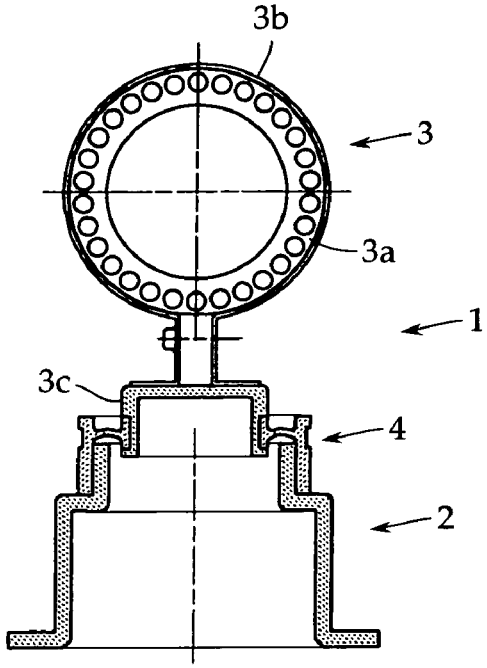
PRIOR ART FIG. 3B
FIG. 3B is a front sectional view of FIG. 3A.

The unit case 35 is a cylindrical case for assembling the microphone unit 40, and corresponds to the unit case 3*a* shown in FIG. 3B. In this example as well, the unit case 35 is formed with many sound diffraction holes 36 arranged in a concentric circle.

As shown in FIG. 2, in the unit case 35, a diaphragm 41, a spacer ring 42, and a backplate 43, which are components of the microphone unit 40, are housed in that order. The back surface side of the backplate 43 is tightened, for example, by a screw ring 44.

According to the present invention, after the microphone unit 40 has been assembled in the unit case 35 as described above, the connecting portion 33 of the unit mounter 30 is fitted on the sleeve 22 of the support bracket 20. Merely by performing the above-described work, the assembly of the microphone device 10 is completed.

Thereupon, the assembling workability can be improved significantly as compared with the conventional example shown in FIG. 3. Also, even if the microphone device 10 is subjected to a strong shock such as a drop shock, there is no fear that the shock mount 34 comes off from the unit mount 30 or that the microphone unit 40 drops.

Although the microphone unit 40 is of a single diaphragm type in this embodiment, it may be of a double diaphragm type. Also, the present invention is not limited to a condenser microphone, but can be applied to a dynamic microphone.

Further, the present invention can be applied to a hand (handheld type) microphone besides a stand microphone. In short, all modes in which the unit mounter and the shock mount are formed integrally by an elastic body exhibiting rubber elasticity are embraced in the present invention.

The invention claimed is:

1. A microphone device comprising:

a support bracket, a microphone unit, and a unit mounter supported on the support bracket and holding the microphone unit thereon, said unit mounter including a base, a connecting portion connected to the support bracket, and a thin portion situated between the base and the connecting portion and having an annular shape to operate as a vibration absorbing device, said base, connecting portion and thin portion being integrally formed together as one unit by one material such that the thin portion exhibits rubber elasticity to absorb vibration, and the base and the connecting portion are made thicker than the thin portion to provide predetermined hardness having a difficult-to-deform property.

2. The microphone device according to claim 1, wherein said unit mounter further includes a unit support portion integrally formed with the base for supporting the microphone unit as a thick body achieving predetermined hardness by means of the elastic material.

3. The microphone device according to claim 2, wherein said microphone unit is of a condenser type, and said unit support portion integrally includes a unit case for said microphone unit.

4. The microphone device according to claim 2, wherein said thin portion has a washer shape.

5. The microphone device according to claim 4, wherein said support bracket has an annular sleeve, and said connecting portion has a cylindrical shape disposed over the annular sleeve.

* * * * *